US006761620B2

(12) United States Patent
Naujok

(10) Patent No.: US 6,761,620 B2
(45) Date of Patent: Jul. 13, 2004

(54) FINISHING PAD DESIGN FOR MULTIDIRECTIONAL USE

(75) Inventor: Markus Naujok, Wappingers Falls, NY (US)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 10/436,007

(22) Filed: May 12, 2003

(65) Prior Publication Data

US 2004/0053570 A1 Mar. 18, 2004

Related U.S. Application Data

(62) Division of application No. 10/243,879, filed on Sep. 13, 2002, now Pat. No. 6,602,123.

(51) Int. Cl.[7] ..... B24B 1/00
(52) U.S. Cl. ..... 451/41; 451/59; 451/527
(58) Field of Search ..... 451/41, 59, 60, 451/63, 527, 528, 529, 530, 537, 539, 550

(56) References Cited

U.S. PATENT DOCUMENTS

| | | | | |
|---|---|---|---|---|
| 2,690,661 A | * | 10/1954 | Briggs | 66/191 |
| 3,211,634 A | | 10/1965 | Lorenzo | |
| 4,728,552 A | * | 3/1988 | Jensen, Jr. | 428/91 |
| 5,177,908 A | | 1/1993 | Tuttle | |
| 5,318,604 A | | 6/1994 | Gorsuch et al. | |
| 5,534,106 A | | 7/1996 | Cote et al. | |
| 5,609,517 A | | 3/1997 | Lofaro | |
| 5,681,217 A | | 10/1997 | Hoopman et al. | |
| 5,938,515 A | * | 8/1999 | McLain et al. | 451/528 |
| 6,106,382 A | | 8/2000 | Sakaguchi | |
| 6,238,271 B1 | | 5/2001 | Cesna | |
| 6,261,168 B1 | | 7/2001 | Jensen et al. | |
| 6,312,485 B1 | * | 11/2001 | Kaiser et al. | 51/299 |
| 6,354,919 B2 | | 3/2002 | Chopra | |
| 6,419,574 B1 | | 7/2002 | Takahashi et al. | |
| 6,488,575 B2 | | 12/2002 | Agarwal et al. | |
| 6,497,793 B1 | | 12/2002 | Ahonen et al. | |
| 6,500,054 B1 | | 12/2002 | Ma et al. | |
| 2001/0044263 A1 | | 11/2001 | Andideh, et al. | |

FOREIGN PATENT DOCUMENTS

| | | |
|---|---|---|
| JP | 08132342 | 5/1996 |

* cited by examiner

*Primary Examiner*—Hadi Shakeri
(74) *Attorney, Agent, or Firm*—Slater&Matsil, L.L.P.

(57) ABSTRACT

A polishing pad (for example, polishing pad 305) for use in planarization of a semiconductor wafer (for example, semiconductor wafer 420), the polishing pad 305 featuring a plurality of different polishing surfaces, depending upon the direction of the movement of the polishing pad 305. The polishing pad 305 may take the form of a polishing disc or a polishing belt. The planarization of the semiconductor wafer 420 can then take place at a fewer number of polishing stations, thereby reducing the amount of time needed and reducing the probability of damage to the semiconductor wafer 420.

17 Claims, 7 Drawing Sheets

FINISHING PAD DESIGN FOR MULTIDIRECTIONAL USE

This application is a divisional of patent application Ser. No. 10/243,879, entitled "Finishing Pad Design for Multidirectional Use," filed on Sep. 13, 2002, now U.S. Pat. No. 6,602,123, issued Aug. 5, 2003, which application is hereby incorporated herein by reference.

FIELD OF THE INVENTION

This invention relates generally to integrated circuit fabrication and particularly to the preparation of a surface of a semiconductor wafer, commonly referred to as planarization, prior to the actual fabrication of the integrated circuits.

BACKGROUND OF THE INVENTION

Semiconductor wafers (or simply, wafers), used for the fabrication of integrated circuits, need to be made essentially flat and smooth prior to and within the process of the actual creation of the integrated circuits. The wafer must be perfectly flat and smooth in order to increase wafer yield, i.e., maximize the number of good integrated circuits created on the wafer. A wafer that is not flat or has grooves, nicks, or scratches will likely result in a significant number of faulty integrated circuits if it were to be used unplanarized to create integrated circuits.

The wafers are usually sawed from large ingots of the semiconductor material and then flattened and polished on polishing wheels and/or belts. In the process of creating integrated circuits on the wafer, several materials are deposited on the wafer, and some of these materials need to be removed. These materials may be removed in a subsequent process step, such as polishing.

Depending on the materials and/or the process requirements, the wafers are first flattened by a first polishing wheel (or belt) with a relatively coarse abrasive surface and then polished by a second polishing wheel (or belt) with a relatively fine abrasive surface. The wafer may undergo several flattening and polishing steps, depending on how flat and smooth the wafer needs to be.

Between each flattening and polishing step, the wafer is usually transferred to a different flattening/polishing station and cleaned or treated with chemicals. The wafer is transferred to different flattening and polishing stations since the different steps cannot be performed by (or at) a single station and the wafer is cleaned or treated with chemicals to reduce any undesired changes on the surface of the wafer, e.g., through oxidation that occurs when the wafer is exposed to oxygen and any other impurities that may have accumulated onto the surface of the wafer. The transferring and cleaning of the wafer results in a delay in the integrated circuit fabrication process and increases the overall costs. Additionally, the movement of the wafer in and out of the stations increases the probability of damage to the wafer.

A need has therefore arisen for a method and apparatus for flattening and polishing a semiconductor wafer that minimizes the need to move and to clean the wafer.

SUMMARY OF THE INVENTION

In one aspect, the present invention provides a polishing pad for use in planarization of semiconductor wafers comprising a polishing pad surface, a series of multifaceted appendages formed on the polishing pad surface, wherein each of the multifaceted appendages has a facet arranged orthogonal to a direction of movement of the polishing pad, and wherein each facet of the multifaceted appendages has an abrasive surface property, with each abrasive surface property of a single multifaceted appendage having a different abrasive property quality.

In another aspect, the present invention provides a method for planarizing a semiconductor wafer comprising the steps of moving a polishing pad having a series of multifaceted appendages in a first direction, applying the semiconductor wafer to the moving polishing pad, moving the polishing pad in a second direction, and applying the semiconductor wafer to the moving polishing pad.

The present invention provides a number of advantages. For example, use of a preferred embodiment of the present invention reduces or completely eliminates the need to move a semiconductor wafer between flattening and polishing stations, thereby speeding up the fabrication of the integrated circuits.

Also, use of a preferred embodiment of the present invention reduces the total number of flattening and polishing stations needed to prepare the semiconductor wafer. This reduces the costs involved in the preparation of the wafer and the overall cost of the fabrication of the integrated circuit.

Additionally, use of a preferred embodiment of the present invention reduces the physical handling and movement of the semiconductor wafer. By reducing the number of times that the wafer is handled, the chances of the wafer being damaged is also reduced.

BRIEF DESCRIPTION OF THE DRAWINGS

The above features of the present invention will be more clearly understood from consideration of the following descriptions in connection with accompanying drawings in which.

DETAILED DESCRIPTION OF ILLUSTRATIVE EMBODIMENTS

The making and use of the various embodiments are discussed below in detail. However, it should be appreciated that the present invention provides many applicable inventive concepts, which can be embodied in a wide variety of specific contexts. The specific embodiments discussed are merely illustrative of specific ways to make and use the invention, and do not limit the scope of the invention.

Figure 1A:
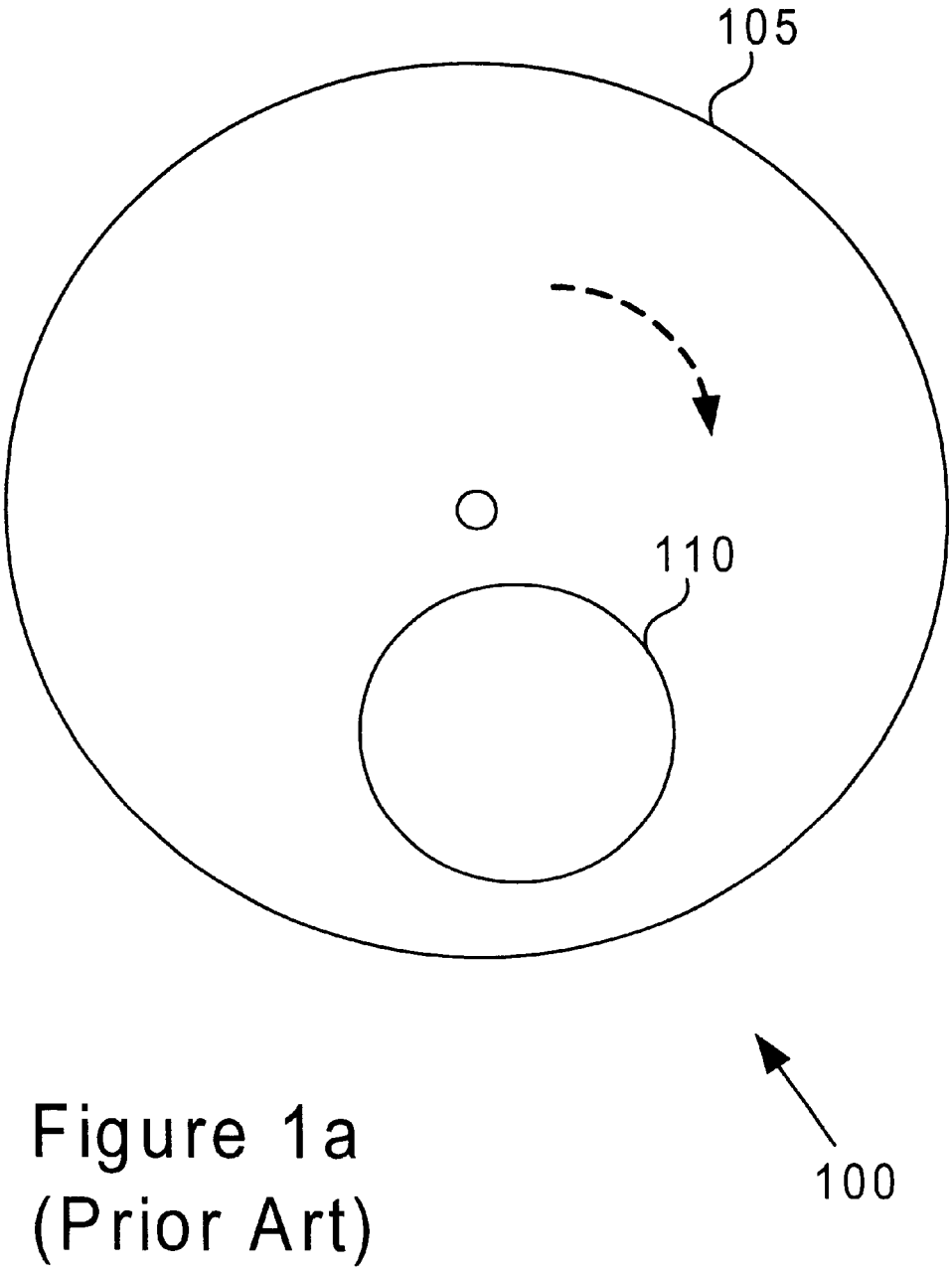
Figure 1a (Prior Art)
FIGS. 1*a* and 1*b* illustrate a top view and a detailed view of a polishing disc used to planarize a semiconductor wafer.
Figure 1B:
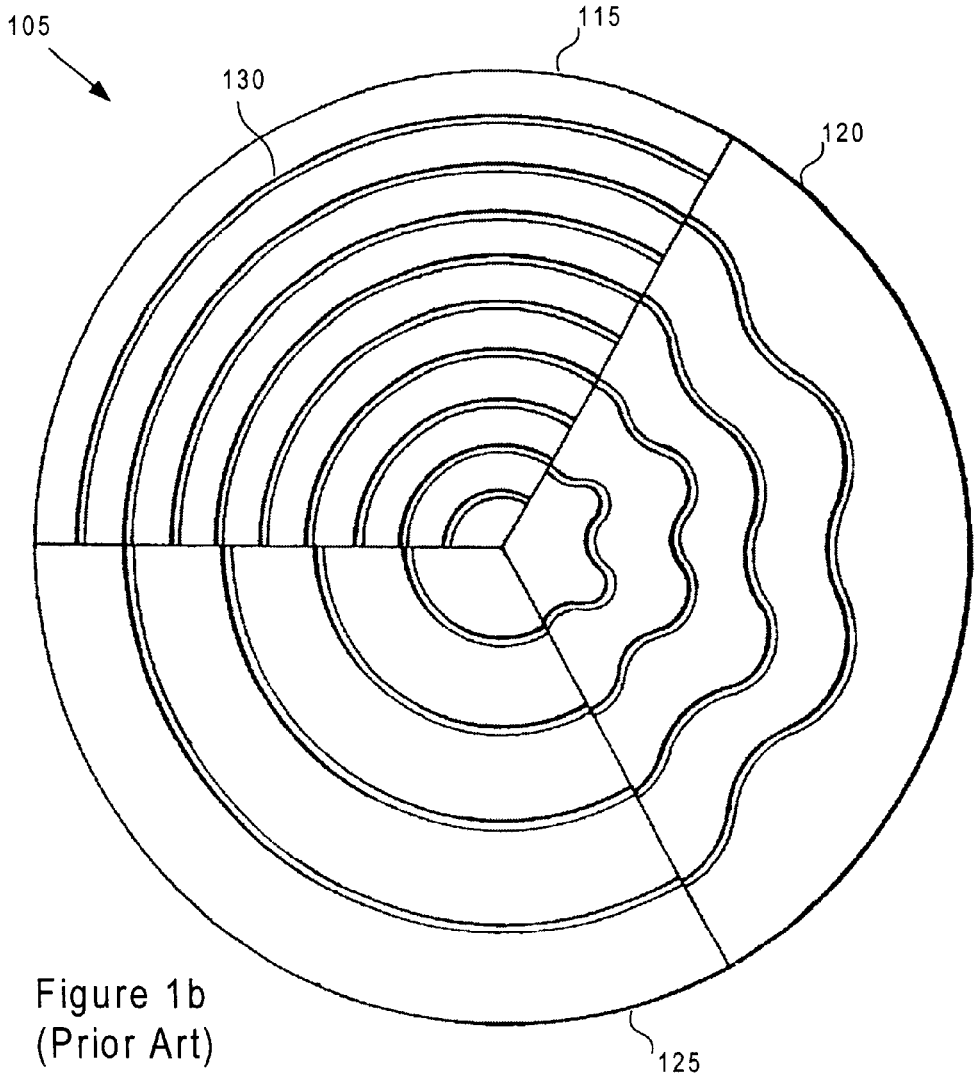
Figure 1b (Prior Art)

Referring now to FIGS. 1*a* and 1*b*, the diagrams illustrate a top view of a prior art disc-based semiconductor wafer planarizer and polisher and a detailed view of a prior art embodiment of a surface of a polishing disc. The use of a polishing disc is one way to planarize a semiconductor wafer. The planarization of a semiconductor wafer involves the flattening of the semiconductor wafer and then polishing at least one of the two surfaces of the semiconductor wafer to a mirror-like finish.

The polishing disc (for example, polishing disc 105) is rotated in either a clock-wise or a counter-clock-wise direction and a semiconductor wafer (for example, semiconductor wafer 110) is pressed against the polishing disc 105. The polishing disc 105 may have an abrasive coating or it may carry an abrasive material. For example, the polishing disc 105 may have an abrasive coating applied to it in a permanent fashion or an abrasive substance, such as a paste or slurry, may be poured onto the polishing disc 105 to give it an abrasive quality. Alternatively, the polishing disc 105 may be designed such that the abrasive substance can emerge through the polishing disc 105 itself.

The act of pressing the semiconductor wafer 110 against the polishing disc 105 results in the abrasive material polishing the semiconductor wafer 110. The degree of the polish depends upon the abrasiveness of the abrasive material, the amount of pressure used to press the semiconductor wafer against the polishing disc 105, the amount of time that the semiconductor wafer 110 is applied against the polishing disc 105, and the rotation speed of the polishing disc 105.

Since the abrasive coating (or abrasive paste/slurry) is homogeneous across the entire surface of the polishing disc 105, the degree of polish for the given polishing disc 105 is constant. Note that although the actual surface of the polishing disc 105 may not contain a coating with exactly the same abrasiveness throughout its surface, the fact that the polishing disc 105 is rotated results in a polishing disc 105 with a homogeneous abrasive quality.

FIG. 1*b* displays one possible design for a polishing disc 105. The design uses an abrasive substance, such as a paste or slurry, that can be initially applied to the polishing disk 105 prior to the application of the semiconductor wafer 110 or it can be continually applied during the polishing application. The polishing disc 105 has a series of grooves (for example, groove 130) that is intended to hold the abrasive substance on the polishing disc 105. Note that the pattern and density of the grooves 130 vary in different regions of the polishing disc 105. The variance provides different abrasive substance retention properties to achieve a final desired abrasive quality. Through the continuous application of the polishing paste/slurry, the abrasive quality of the polishing disc 105 is maintained throughout the polishing operation.

Figure 2A:
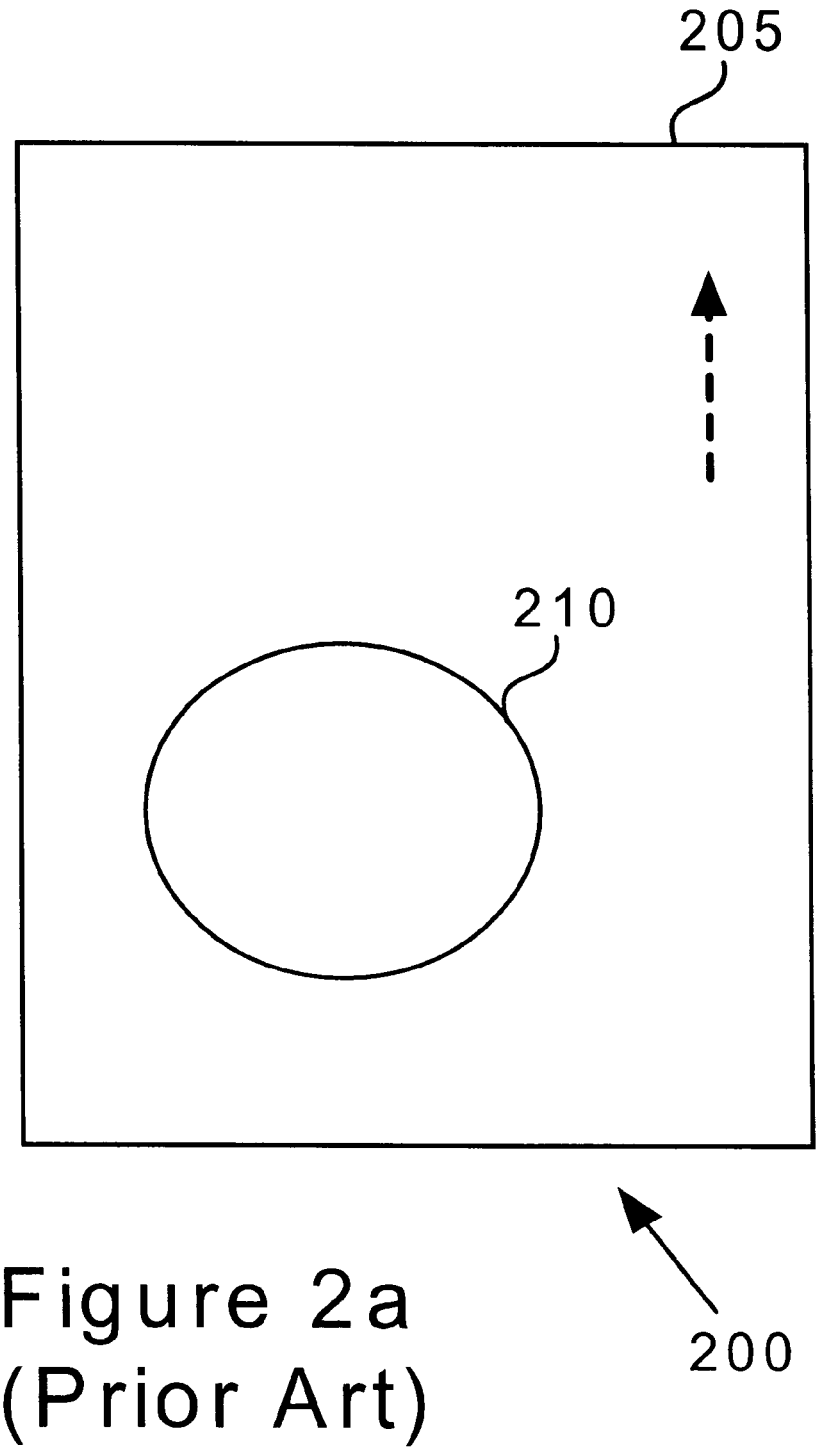
Figure 2a (Prior Art)
FIGS. 2*a* and 2*b* illustrate a top view and a detailed isometric view of a polishing belt used to planarize a semiconductor wafer.
Figure 2B:
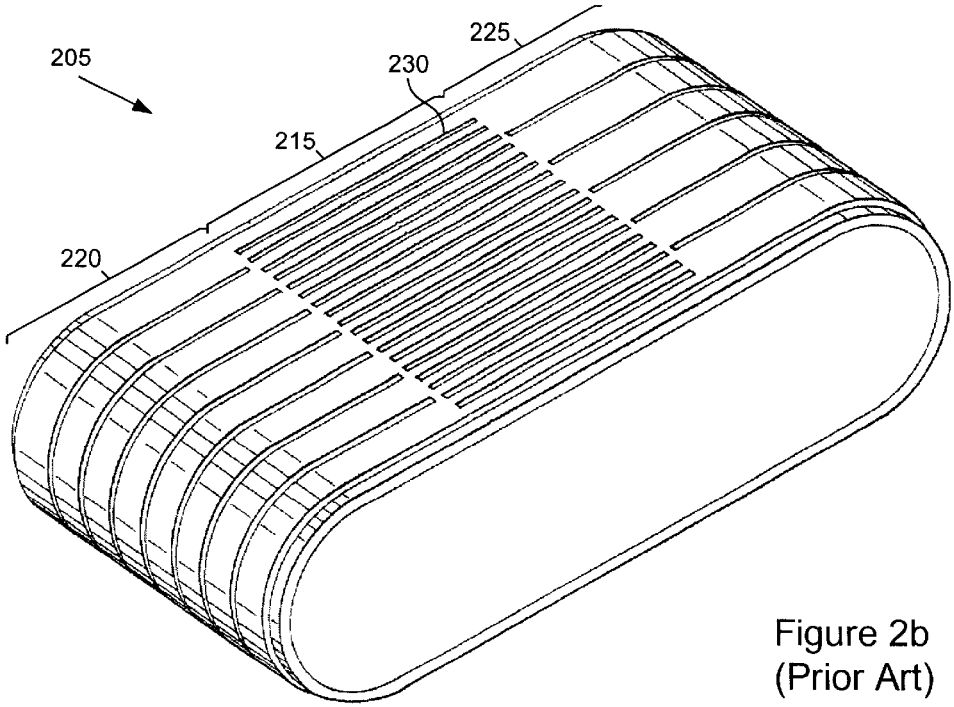
Figure 2b (Prior Art)

Referring now to FIGS. 2*a* and 2*b*, the diagrams illustrate a top view of a prior art belt-based semiconductor wafer planarizer and polisher and a detailed view of a prior art embodiment of a surface of a polishing belt. The polishing belt (for example, polishing belt 205) is rotated on a pair of rollers (not shown) such that the polishing belt 205 moves in a linear fashion along an axis that is perpendicular to the rollers (not shown). A semiconductor wafer (for example, semiconductor wafer 210) is then pressed against the polishing belt 205. As in the case of the polishing disc (FIG. 1*a*), the polishing belt 205 may have an abrasive coating permanently applied to it or it may have an abrasive substance, such as a paste or slurry, which is poured onto the polishing belt 205. Alternatively, the polishing belt 205 may be designed so that the abrasive substance can emerge through the polishing belt 205 itself.

FIG. 2*b* displays a possible design for a polishing belt 205. The design uses an abrasive substance, such as a paste or slurry, to provide the abrasive quality. The polishing belt 205 has a series of grooves (for example, groove 230) that hold the abrasive substance on the polishing belt 205 as it moves. The different grooves along the surface of the polishing belt 205 provide a final desired abrasive quality for the polishing belt 205 in a fashion similar to the grooves on the polishing disc 105 (FIG. 1*b*).

Although the two different embodiments for the polishing disc (FIG. 1*b*) and the polishing belt (FIG. 2*b*) have different groove patterns that effectively provide different abrasive qualities to the immediate region of the disc and belt, the fact that the polishing belt and the polishing disc are rapidly rotated results in a polishing surface with a homogeneous abrasive quality. Therefore, to achieve a different abrasive quality, the polishing belt and the polishing disc must be replaced with a different polishing belt/disc with a different polishing quality.

Alternatively, the semiconductor wafer must be moved to a different polishing belt/disc. The movement of the semiconductor wafer increases the probability of damage occurring to the semiconductor wafer, hence ruining the semiconductor wafer. Additionally, when the semiconductor wafer is moved, its previously polished surface is exposed to the atmosphere where it is exposed to oxygen (which oxides the polished surface) and other contaminants (which can decrease the yield of the semiconductor wafer). Therefore, the semiconductor wafer must be cleaned after each time it is moved. The added cleaning steps only serve to slow down the manufacturing process and to increase costs.

Figure 3:
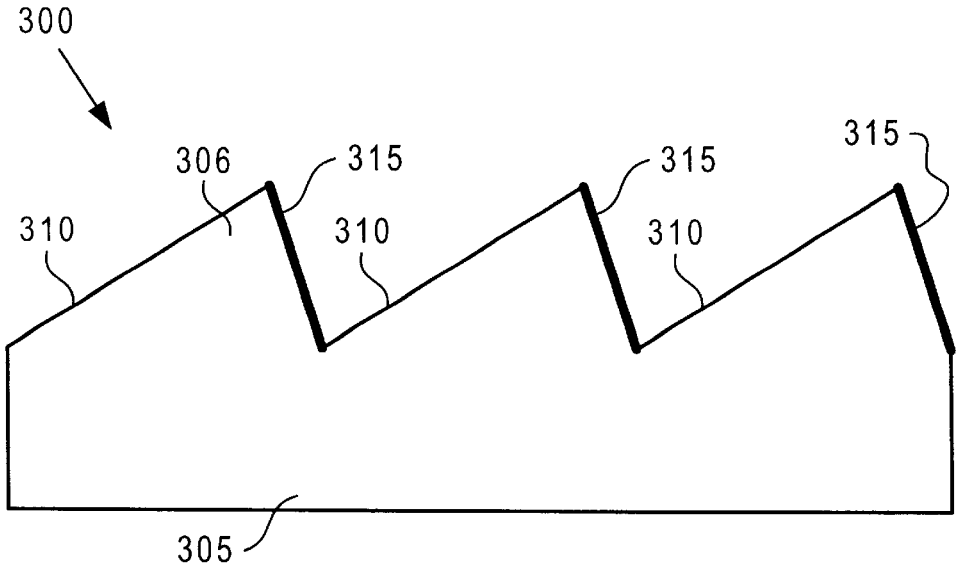
FIG. 3 illustrates a cross-sectional view of a polishing belt that is used to provide a plurality of different abrasive qualities depending upon the direction of the movement of the polishing belt according to a preferred embodiment of the present invention.

Referring now to FIG. 3, the diagram illustrates a cross-sectional view of a portion 300 of a polishing belt (or disc) 305, wherein the polishing surface has a plurality of polishing surfaces, according to a preferred embodiment of the present invention. Note that the cross-sectional view displayed in FIG. 3 would also be applicable for a polishing disc. The polishing belt 305, as displayed in FIG. 3, has a series of triangular ridges oriented perpendicularly to the direction of belt movement. For example, as displayed in FIG. 3, the direction of movement of the polishing belt 305 would either be in the left to right or right to left direction. Alternatively, if the cross section were from a polishing disc, then the ridges would spread radially from the center of the polishing disc and the facets would be perpendicular to the angular movement of the polishing disc.

Each ridge, for example, ridge 306, has two polishing surfaces. A first polishing surface 310 has a certain first abrasive quality and a second polishing surface 315 has a certain second abrasive quality. Preferably, the ridges would be made from a flexible material that would be able to deform under a load, but would be able to spring back to its original shape after the load is removed. According to a preferred embodiment of the present invention, each of the two polishing surfaces would have a different abrasive quality. Other ridges present in the polishing belt 305 would also have two polishing surfaces, each with its own abrasive quality. According to a preferred embodiment of the present invention, each ridge's first polishing surface would have the same abrasive quality, with the same being true for each ridge's second polishing surface. According to yet another preferred embodiment of the present invention, the ridges are canted at a specified angle to help maximize the contact between the different polishing surfaces and the semiconductor wafer. The canting of the ridges at a specified angle helps to generate a difference in the amount of contact between the semiconductor wafer and the polishing surfaces.

Although the polishing belt is displayed as having ridges with two polishing surfaces, it is possible that the polishing belt have different shaped features on its surface and that the shapes could have more than two different polishing surfaces. For example, the polishing belt may have rectangular-shaped fingers on its surface and each surface of the rectangular-shaped fingers could have a different polishing surface, with each polishing surface having a different abrasive quality.

Figure 4A:
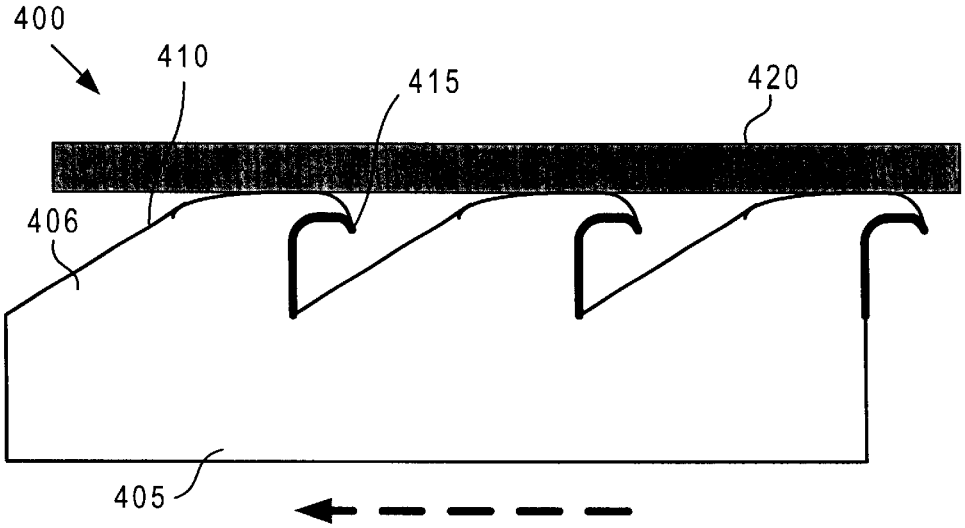
FIGS. 4*a* and 4*b* illustrate the use of the polishing belt displayed in FIG. 3 to provide different abrasive qualities depending upon the direction of the movement of the polishing belt according to a preferred embodiment of the present invention.
Figure 4B:
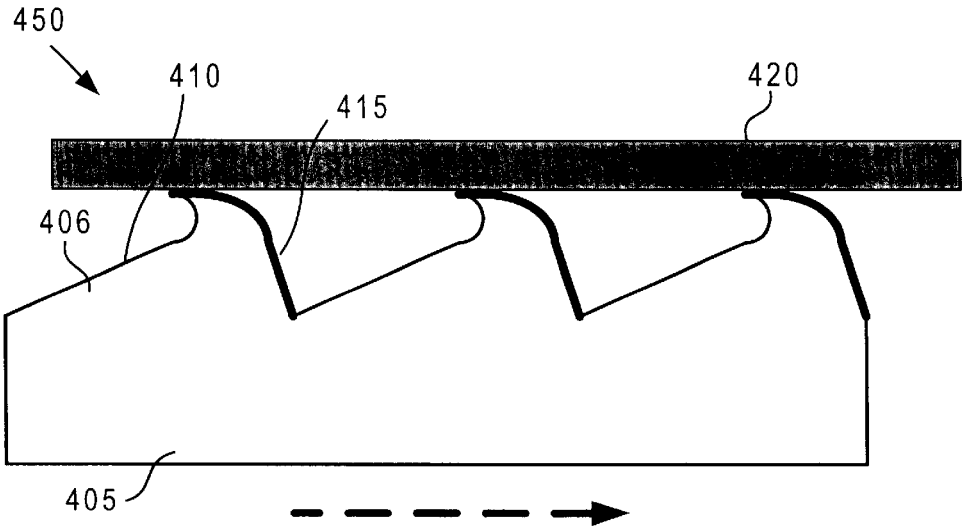

As the polishing belt 305 is spun, the polishing surface that is presented to a semiconductor wafer changes depending on the direction of the spinning. For example, if the polishing belt 305 is spun from right to left, then the first polishing surface 310 would be presented to the semiconductor wafer while the second polishing surface 315 would not be presented to the semiconductor wafer. FIGS. 4*a* and 4*b* illustrate this feature.

According to a preferred embodiment of the present invention, an abrasive slurry may be deposited onto the polishing surface prior to the planarization of the semiconductor wafer. In many cases, the combination of the abrasive slurry and the triangular ridges provides the necessary abrasiveness to planarize the semiconductor wafer. According to yet another preferred embodiment of the present invention, prior to the change in direction of the polishing surface, additional abrasive slurry is deposited onto the polishing surface. The additional abrasive slurry may have the identical properties as the abrasive slurry first deposited onto the polishing surface, e.g., to renew the abrasive slurry on the polishing surface. Alternatively, the additional abrasive slurry may have different properties from the abrasive slurry first deposited onto the polishing surface.

Referring now to FIG. 4*a*, the diagram illustrates a cross-section of a polishing belt (or disc) 405 with triangular ridges, wherein each ridge has two polishing surfaces 410 and 415, when the polishing belt is spun in a right to left direction, according to a preferred embodiment of the present invention. As displayed in FIG. 4*a*, as the polishing belt 405 is spun from right to left and as a semiconductor wafer 420 is pressed against the polishing belt 405, the ridges deform under the load. The ridges bend over, exposing the first polishing surface 410 to the semiconductor wafer 420. This occurs to each ridge as it moves under the semiconductor wafer 420, and as the ridges from underneath the semiconductor wafer 420, the ridges would spring back to their original shape. Note that although FIG. 4*a* displays a polishing belt, a polishing disc with ridges on its surface would behave in a similar manner.

Referring now to FIG. 4*b*, the diagram illustrates a cross-section of the polishing belt 405, when the polishing belt 405 is spun in a left to right direction, according to a preferred embodiment of the present invention. When the polishing belt 405 is spun in the opposite direction (in relation to that displayed in FIG. 4*a*), the ridges deform in an opposite direction and expose the second polishing surface 415 to the semiconductor wafer 420.

FIGS. 4*a* and 4*b* illustrate a polishing belt that can change its abrasive quality depending on the direction of its spin in relation to a semiconductor wafer. The use of such a polishing belt (or polishing disc) can reduce the total number of different polishing stations that a semiconductor wafer must visit during its planarization process. For example, if it is customary for a semiconductor wafer to visit two polishing stations when ordinary polishing belts are used, then use of a preferred embodiment of the present invention can perform the planarization process in a visit to a single polishing station. Initially, the polishing belt would be spun in one direction, for example, from right to left. This would perhaps expose a coarser abrasive to the semiconductor wafer. The coarser abrasive would rapidly flatten the semiconductor wafer. Once the semiconductor is flattened to an acceptable degree, then the direction of the polishing belt spin can be reversed. This would then expose a finer abrasive to the semiconductor wafer. The finer abrasive would put the final mirror-like finish on the semiconductor wafer.

Figure 5A:
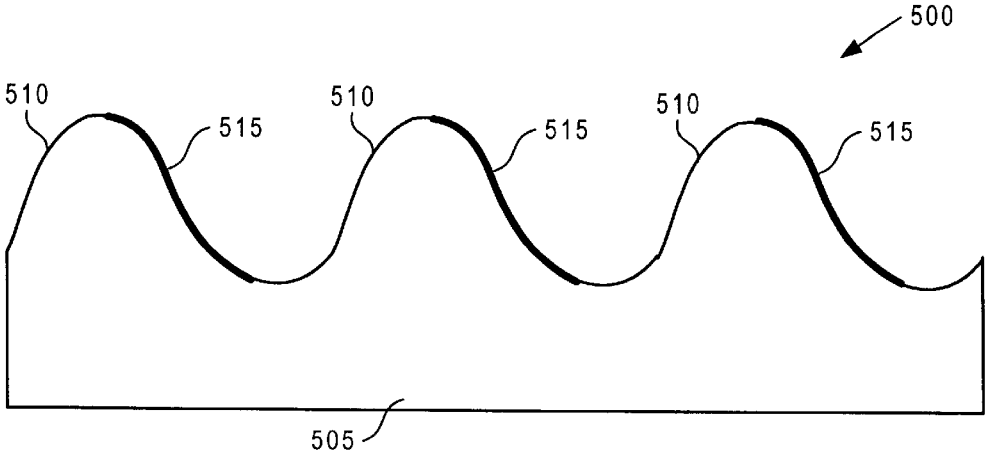
FIGS. 5*a*–5*c* illustrate cross-sectional views of different alternative embodiments for the polishing belt that provides different abrasive qualities depending on the direction of the movement of the polishing belt according to a preferred embodiment of the present invention.
Figure 5B:
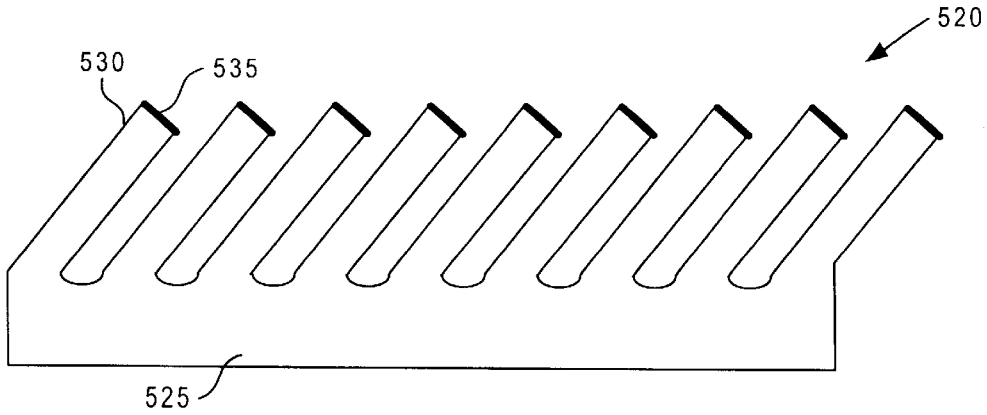
Figure 5C:
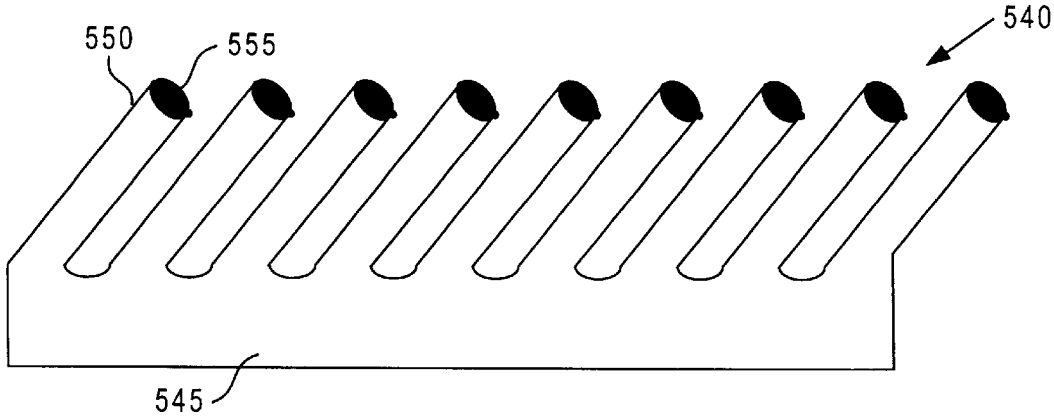

FIGS. 4*a* and 4*b* illustrate a polishing belt with ridges that have two different polishing surfaces on each ridge. Other topologies can be used to provide different polishing surfaces on the polishing belt (or polishing disc). For example, a series of semi-circular (or other rounded shapes) mounds and valleys (FIG. 5*a*) or rectangular walls (FIG. 5*b*) can be used to provide different polishing surfaces. Alternatively, fine fibers (FIG. 5*c*) with one polishing surface on the shaft of the fibers and another polishing surface on the fiber's tip can be used. The use of fibers can perhaps afford easier fabrication of the polishing belt.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A method for planarizing a semiconductor wafer comprising:

moving a polishing pad having a series of multifaceted appendages in a first direction, wherein each multifaceted appendage comprises first and second facets, wherein said first and second facets have different abrasive surface properties;

applying the semiconductor wafer to the moving polishing pad, wherein substantially only the first facets of the multifaceted appendages are applied to the semiconductor wafer;

moving the polishing pad in a second direction opposite to the first direction; and applying the semiconductor wafer to the moving polishing pad, wherein substantially only the second facets of the multifaceted appendages are applied to the semiconductor wafer.

2. The method of claim 1 further comprising the step of applying a first abrasive slurry prior to moving the polishing pad in the first direction.

3. The method of claim 2 further comprising the step of applying a second abrasive slurry prior to moving the polishing pad in the second direction.

4. The method of claim 3, wherein the first and second abrasive slurries have different properties.

5. The method of claim 3, wherein the first and second abrasive slurries have identical properties.

6. The method of claim 1, wherein the facets on each multifaceted appendage are oriented orthogonally to the first and second directions of movement of the polishing pad.

7. The method of claim 1, further comprising:

removing the semiconductor wafer from the polishing pad after the first applying step; and stopping the polishing pad after removing the semiconductor wafer.

8. The method of claim 1, wherein the polishing pad is a polishing belt and the first and second directions are linearly opposite of each other.

9. The method of claim 1, wherein the polishing pad is a polishing disc and the first and second directions are angularly opposite of each other.

10. The method of claim 1, wherein an amount of pressure and a duration for the first and second applying steps can vary depending on a degree of planarization desired.

11. A method of polishing a semiconductor wafer, said method comprising:

moving a polishing pad having a set of appendages in a first direction, wherein each appendage comprises first and second facets, wherein said first and second facets have different abrasive surface properties;

applying the semiconductor wafer to the moving polishing pad, wherein substantially only the first facets of the multifaceted appendages polish the semiconductor wafer;

moving the polishing pad in a second direction opposite to the first direction; and applying the semiconductor wafer to the moving polishing pad, wherein substantially only the second facets of the multifaceted appendages polish the semiconductor wafer.

12. The method of claim 1, wherein the set of appendages is former from a flexible material.

13. The method of claim 1, wherein said first and second directions are linearly opposite each other.

14. The method of claim 1, wherein said first and second directions are angularly opposite each other.

15. Me method of claim 1, wherein said abrasive surface property of said first facets is coarser than said abrasive surface property of said second facets.

16. The method of claim 1, further comprising using a first abrasive slurry when said first facets are polishing said wafer, and using a second abrasive slurry when said second facets are polishing said wafer.

17. The method of claim 1, wherein said first and second facets are orthogonal to said first and second directions of movement of said polishing pad.

* * * * *

UNITED STATES PATENT AND TRADEMARK OFFICE

CERTIFICATE OF CORRECTION

PATENT NO. : 6,761,620 B2
DATED : July 13, 2004
INVENTOR(S) : Naujok

It is certified that error appears in the above-identified patent and that said Letters Patent is hereby corrected as shown below:

Column 3,
Line 27, insert -- 110 -- between “wafer” and “ against”.

Column 8,
Lines 6,8,10,12,15 and 19, delete “claim 1” and insert -- claim 11 --.
Line 7, delete “former” and insert -- formed --.
Line 12, delete “Me” and insert -- The --.

Signed and Sealed this

Thirty-first Day of August, 2004

JON W. DUDAS
*Director of the United States Patent and Trademark Office*